US012638206B2

(12) United States Patent
Ramasamy et al.

(10) Patent No.: US 12,638,206 B2
(45) Date of Patent: May 26, 2026

(54) SYSTEM AND METHOD OF OPERATING AN HVAC SYSTEM BASED ON TOTAL VOLATILE ORGANIC COMPOUNDS

(71) Applicant: Lennox Industries Inc., Richardson, TX (US)

(72) Inventors: Surendran Ramasamy, Chennai (IN); Sanjeev Hingorani, Gainesville, FL (US); Thomas John Wolowicz, Allen, TX (US); Harsh Patel, Arlington, TX (US)

(73) Assignee: Lennox Industries Inc., Richardson, TX (US)

( * ) Notice: Subject to any disclaimer, the term of this patent is extended or adjusted under 35 U.S.C. 154(b) by 637 days.

(21) Appl. No.: 18/158,081

(22) Filed: Jan. 23, 2023

(65) Prior Publication Data

US 2024/0247833 A1 Jul. 25, 2024

(51) Int. Cl.

| | |
|---|---|
| ***F24F 11/65*** | (2018.01) |
| ***F24F 11/00*** | (2018.01) |
| ***F24F 11/89*** | (2018.01) |
| *F24F 110/66* | (2018.01) |

(52) U.S. Cl.

CPC ..... *F24F 11/65* (2018.01); *F24F 11/0001* (2013.01); *F24F 11/89* (2018.01); *F24F 2110/66* (2018.01)

(58) Field of Classification Search

None

See application file for complete search history.

(56) References Cited

U.S. PATENT DOCUMENTS

| | | | | |
|---|---|---|---|---|
| 10,767,879 | B1 * | 9/2020 | Burnett | F24F 11/30 |
| 11,137,163 | B2 * | 10/2021 | Nasis | F24F 11/89 |
| 11,156,378 | B2 * | 10/2021 | Bykowski | A61B 5/082 |
| 11,268,725 | B2 * | 3/2022 | Chen | F24F 8/10 |
| 11,932,080 | B2 * | 3/2024 | Varughese | B60H 3/0616 |
| 2010/0298981 | A1 * | 11/2010 | Chamorro | F24F 11/50 700/276 |
| 2016/0209070 | A1 * | 7/2016 | Hrejsa | F24F 11/523 |
| 2018/0299159 | A1 * | 10/2018 | Ajax | F24F 11/46 |

(Continued)

OTHER PUBLICATIONS

Ramasamy, Surendran; System and method of operating an HVAC system based on particulate matter and air filter efficiency; U.S. Appl. No. 18/158,163, filed Jan. 23, 2023.

*Primary Examiner* — Howard Cortes

(74) *Attorney, Agent, or Firm* — Baker Botts L.L.P.

(57) ABSTRACT

A controller is configured to operate a heating, ventilation, and air conditioning (HVAC) system based on a plurality of concentration measurements received from a gas sensor, wherein the gas sensor is disposed within a sensor housing upstream of an evaporator coil. The controller is configured to receive the plurality of concentration measurements and determine if a concentration of total volatile organic compounds (TVOCs) in an airflow exceeds a first threshold value. The controller is further configured to operate the HVAC system in a second mode of operation to increase ventilation in response to determining that the concentration of TVOCs in the airflow does exceed the first threshold value, wherein a volume of air is introduced into and discharged from the HVAC system during the second mode of operation.

20 Claims, 6 Drawing Sheets

(56) References Cited

U.S. PATENT DOCUMENTS

| | | | | |
|---|---|---|---|---|
| 2018/0346130 | A1* | 12/2018 | Jouper | G08B 21/12 |
| 2019/0063762 | A1* | 2/2019 | Lee | F24F 3/1429 |
| 2019/0195848 | A1* | 6/2019 | Mou | G01N 33/0063 |
| 2021/0140650 | A1* | 5/2021 | Wilson | F24F 11/32 |
| 2021/0236979 | A1* | 8/2021 | Pham | F24F 11/64 |
| 2022/0170882 | A1* | 6/2022 | Ranjan | G01N 27/12 |
| 2022/0203288 | A1* | 6/2022 | Wenger | B01D 46/0028 |
| 2023/0011991 | A1* | 1/2023 | Xu | F24F 11/74 |
| 2023/0204244 | A1* | 6/2023 | AlKubaisi | F24F 11/72 454/244 |
| 2023/0243542 | A1* | 8/2023 | Chakraborty | F24F 11/65 454/229 |
| 2023/0366581 | A1* | 11/2023 | Hingorani | F24F 11/63 |
| 2023/0383978 | A1* | 11/2023 | Michaelis | F24F 11/88 |
| 2024/0167707 | A1* | 5/2024 | Fernandes Lopes | F24F 11/58 |
| 2024/0247833 | A1* | 7/2024 | Ramasamy | F24F 11/89 |
| 2024/0361736 | A1* | 10/2024 | Brown | G16H 40/20 |
| 2024/0377092 | A1* | 11/2024 | Horton | F24F 11/65 |

* cited by examiner

SYSTEM AND METHOD OF OPERATING AN HVAC SYSTEM BASED ON TOTAL VOLATILE ORGANIC COMPOUNDS

TECHNICAL FIELD

The present disclosure relates generally to heating, ventilation, and air conditioning (HVAC) system control, and more specifically to a system and method of operating an HVAC system based on total volatile organic compounds.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. During operation, the airflow may contain a quantity of particulate matter or a concentration of volatile organic compounds harmful to users.

SUMMARY

HVAC systems generally provide cooled or heated air to a space to improve comfort of occupants of the space. This disclosure recognizes that other qualities of air in the conditioned space can also be monitored, and that intelligent actions can be taken to improve indoor air quality. To achieve this and other improvements over previous technology, this disclosure provides an intelligent system that receives information about indoor air quality and uses this information to provide efficient and reliable remediation of any air qualities that are outside a desired range. Mitigation actions are selected based on real-time indoor and/or outdoor air quality metrics, recent trends of individual contaminant levels, and/or previous air cleaning attempts, such that efficient and effective mitigations are executed to improve the air quality in a space. Altogether the improved system facilitates an automated approach to maintaining air quality at desired levels, while reporting air quality information to the users via real-time visual indicators and with retrospective/historical data. For example, trends in attempted mitigations and associated air quality can be used to identify system failures or flag unhealthy air quality exposures. Certain embodiments may include none, some, or all of the above technical advantages. One or more other technical advantages may be readily apparent to one skilled in the art from the figures, descriptions, and claims included herein.

In one embodiment, the heating, ventilation, and air conditioning (HVAC) system comprises an evaporator coil configured to receive an airflow and to transfer heat from the received airflow to a flow of refrigerant. The system further comprises a compressor configured to receive the flow of refrigerant from the evaporator coil and to discharge the flow of refrigerant at a higher pressure. The system further comprises a first sensor housing disposed upstream of the evaporator coil. The first sensor housing comprises a gas sensor configured to detect a concentration of total volatile organic compounds (TVOCs) within the airflow. The first sensor housing further comprises a first controller, operably coupled to the gas sensor, comprising a first memory and a first processor. The first memory is configured to store a plurality of concentration measurements, and the first processor is configured to receive the plurality of concentration measurements from the gas sensor.

The system further comprises a unit controller operably coupled to the first controller, comprising a unit memory and a unit processor. The unit memory is configured to store a first threshold value associated with the concentration of TVOCs. The unit processor is operably coupled to the unit memory and configured to operate the HVAC system in a first mode of operation, wherein operating the HVAC system in the first mode of operation comprises sending a command to actuate the evaporator coil and the compressor. The unit processor is further configured to receive the plurality of concentration measurements from the first controller. The unit processor is further configured to determine if the concentration of TVOCs in the airflow exceeds the first threshold value based on the received plurality of concentration measurements. In response to determining that the concentration of TVOCs in the airflow does exceed the first threshold value, the unit processor is configured to operate the HVAC system in a second mode of operation to increase ventilation, wherein during the second mode of operation, a volume of air is introduced into and discharged from the HVAC system.

In another embodiment, the heating, ventilation, and air conditioning (HVAC) system comprises an evaporator coil configured to receive an airflow and to transfer heat from the received airflow to a flow of refrigerant. The system further comprises a compressor configured to receive the flow of refrigerant from the evaporator coil and to discharge the flow of refrigerant at a higher pressure. The system further comprises a first sensor housing disposed upstream of the evaporator coil. The first sensor housing comprises a first air quality sensor configured to detect a quantity of particulate matter within the airflow. The first sensor housing further comprises a first controller, operably coupled to the first air quality sensor, comprising a first memory and a first processor. The first memory is configured to store a first plurality of particulate matter measurements, and the first processor is configured to receive the first plurality of particulate matter measurements from the first air quality sensor. The system further comprises a second sensor housing disposed between the first sensor housing and the evaporator coil. The second sensor housing comprises a second air quality sensor configured to detect the quantity of particulate matter within the airflow. The second sensor housing further comprises a second controller, operably coupled to the second air quality sensor, comprising a second memory and a second processor. The second memory is configured to store a second plurality of particulate matter measurements, and the second processor is configured to receive the second plurality of particulate matter measurements from the second air quality sensor.

The system further comprises a unit controller operably coupled to both the first controller and the second controller, comprising a unit memory and a unit processor. The unit memory is configured to store a look-up table associated with the quantity of particulate matter. The unit processor is operably coupled to the unit memory and configured to operate the HVAC system in a first mode of operation, wherein operating the HVAC system in the first mode of operation comprises sending a command to actuate the evaporator coil and the compressor. The unit processor is further configured to receive the first plurality of plurality of particulate matter measurements from the first controller and the second plurality of particulate matter measurements from the second controller. The unit processor is further configured to determine if the quantity of particulate matter in the airflow exceeds a first threshold value based on the received second plurality of particulate matter measurements. In response to determining that the quantity of particulate matter in the airflow does exceed the first threshold value, the unit processor is configured to transmit a notification indicating an action to inspect an air filter.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Cooling and heating systems cycle refrigerant to cool and heat various spaces, respectively. For example, a heating, ventilation, and air conditioning (HVAC) system cycles refrigerant to cool spaces near or around air conditioner loads. As described above, prior to the present disclosure, there was a lack of tools for efficiently and automatically monitoring air quality and mitigating any detected air quality issues for these cooling systems. This disclosure provides technical solutions to these and other problems by providing an intelligent HVAC system controller that monitors indoor air quality (e.g., via sensor measurements), determines indoor air quality scores for various quality types (or corresponding contaminants such as particulate matter, volatile organic compounds, carbon dioxide, and the like), determines a mitigation action, and automatically executes the mitigation action. The indoor air quality continues to be monitored after and/or while the mitigation action is performed, and the mitigation action may be repeated, paused, stopped, or changed depending on how the indoor air quality is impacted by attempted mitigation actions. The cooling system will be described using FIGS. 1 through 6, wherein FIG. 1 will describe the overall, improved cooling system, and FIGS. 2-6 will describe the configuration and operation of the components within the cooling system in further detail.

Figure 1:
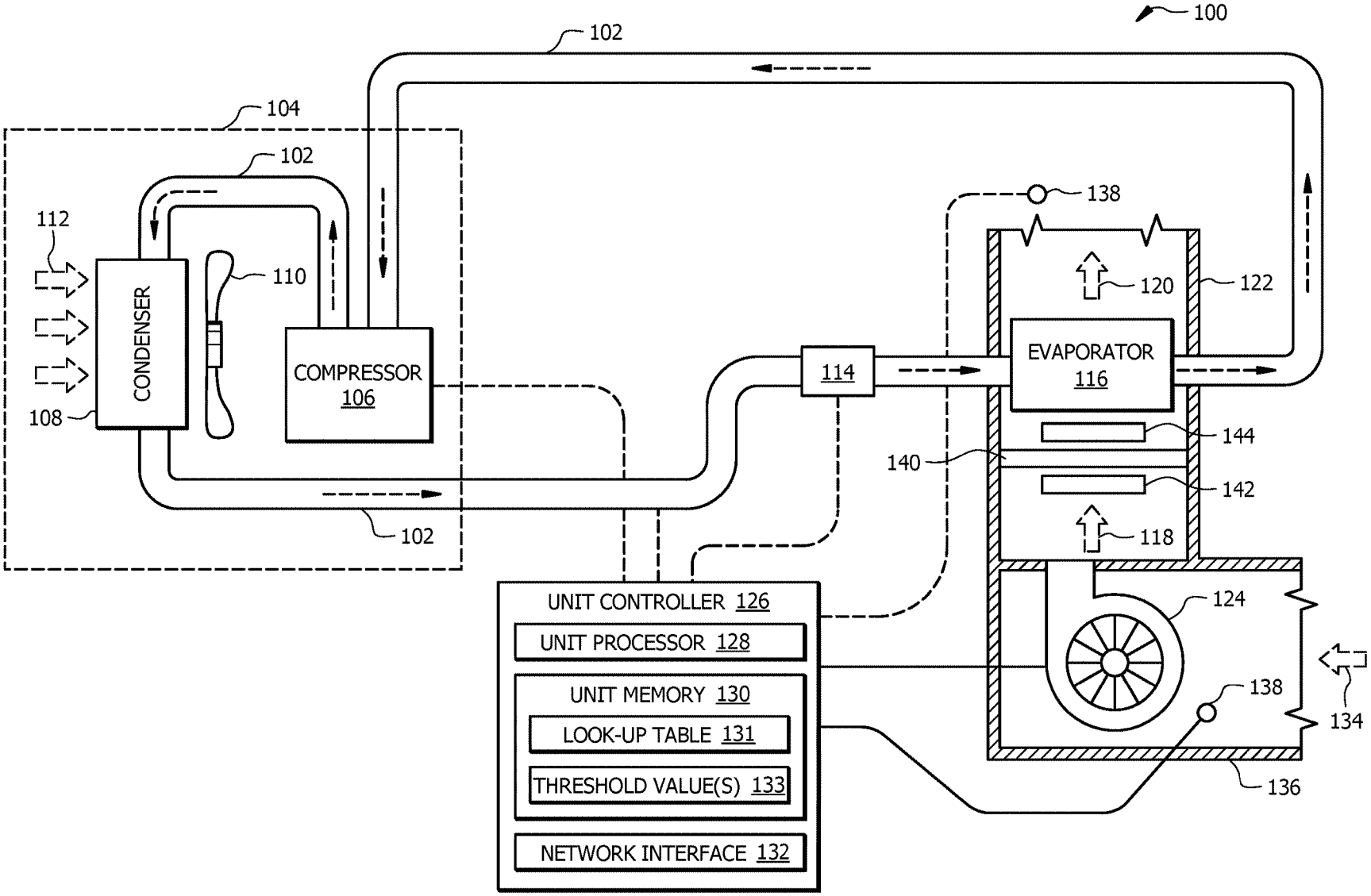
FIG. 1 is a schematic diagram of a HVAC system.

FIG. 1 is a schematic diagram of an embodiment of a HVAC system 100 configured to detect a concentration of total volatile organic compounds (TVOCs) within the airflow and/or a quantity of particulate matter during operations. The HVAC system 100 is generally configured to perform cooling and/or heat pump cycles. The HVAC system 100 conditions air for delivery to an interior space of a building or home. The HVAC system 100 is generally configured to control the temperature of a space. Examples of a suitable space may include, but are not limited to, a room, a home, an apartment, a mall, an office, a warehouse, or a building. In embodiments, the HVAC system 100 may be a rooftop unit (RTU) that is positioned on the roof of a building and the conditioned air is delivered to the interior of the building. In other embodiments, portions of the system may be located within the building and a portion outside the building. The HVAC system 100 may also include heating elements that are not shown here for convenience and clarity. The HVAC system 100 may be configured as shown in FIG. 1 or in any other suitable configuration. For example, the HVAC system 100 may include additional components or may omit one or more components shown in FIG. 1. The HVAC system 100 may comprise a controller or thermostat, compressors, blowers, evaporators, condensers, and/or any other suitable type of hardware for controlling the temperature of the space. Although FIG. 1 illustrates a single HVAC system 100, a location or space may comprise a plurality of HVAC systems 100 that are configured to work together. For example, a large building may comprise multiple HVAC systems 100 that work cooperatively to control the temperature within the building.

The HVAC system 100 may comprise a working-fluid conduit subsystem 102 for moving a working fluid, or refrigerant, through a cooling cycle. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), A2L refrigerants, or any other suitable type of refrigerant.

The HVAC system 100 may comprise one or more condensing units 104. In one embodiment, the condensing unit 104 may comprise a compressor 106, a condenser coil 108, and a fan 110. The compressor 106 is coupled to the working-fluid conduit subsystem 102 that compresses the working fluid. The condensing unit 104 may be configured with a single-stage or multi-stage compressor 106 or with multiple compressors. In a configuration of one or more compressors, the one or more compressors can be turned on or off to adjust the cooling capacity of the HVAC system 100. In some embodiments, a compressor 106 may be configured to operate at multiple speeds or as a variable speed compressor. For example, the compressor 106 may be configured to operate at multiple predetermined speeds.

The condenser 108 is configured to assist with moving the working fluid through the working-fluid conduit subsystem 102. The condenser 108 is located downstream of the compressor 106 for rejecting heat. The fan 110 is configured to move air 112 across the condenser 108. For example, the fan 110 may be configured to blow outside air through the heat exchanger to help cool the working fluid. The fan 110 may be coupled to a motor, wherein the motor may be configured to actuate the fan 110.

With reference back to the flow of the working fluid, the compressed, cooled working fluid flows downstream from the condenser 108 to an expansion device 114, or a metering device. The expansion device 114 is configured to remove pressure from the working fluid. The expansion device 114 is coupled to the working-fluid conduit subsystem 102 downstream of the condenser 108 for removing pressure from the working fluid prior to flowing to an evaporator 116.

The expansion device 114 may be closely associated with the evaporator 116. In this way, the working fluid is delivered to the evaporator 116 and receives heat from airflow 118 to produce a treated airflow 120 that is delivered by a duct subsystem 122 to the desired space, for example, a room in the building.

In embodiments, a blower 124 may be disposed upstream or downstream of the the evaporator 116 and configured to facilitate airflow through the evaporator 116. For example, blower 124 may be actuated to turn on, wherein operation of blower 124 may provide airflow 118 to be directed to flow through the evaporator 116. As illustrated, a unit controller 126 may be in signal communication with the evaporator 116 and the blower 124. Signal communication may be facilitated by using a wired or wireless connection. The unit controller 126 may be configured to provide commands or signals to control the operation of the HVAC system 100. An example of the unit controller 126 in operation is described further below in FIGS. 5-6. For example, the unit controller 126 is configured to send signals to turn on or off the blower 126 to facilitate airflow over the evaporator 116. In another example, the unit controller 126 may be configured to receive a plurality of measurements from a gas sensor, a first air quality sensor, and/or a second air quality sensor (described further below in FIGS. 2A-2D). In this example, the unit controller 126 may transmit instructions to the blower 126 and evaporator 116 based on processing the received plurality of measurements.

As an example, the unit controller 126 may comprise a unit processor 128, a unit memory 130, and a network interface 132. In embodiments, the unit controller 126 may further comprise a graphical user interface, a display, a touch screen, buttons, knobs, or any other suitable combination of components. The unit controller 126 may be configured as shown or in any other suitable configuration.

The unit processor 128 comprises one or more processors operably coupled to the unit memory 130. The unit processor 128 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The unit processor 128 may be a programmable logic device, a microcontroller, a microprocessor, or any suitable combination of the preceding. The unit processor 128 is communicatively coupled to and in signal communication with the unit memory 130 and the network interface 132. The one or more processors may be configured to process data and may be implemented in hardware or software. For example, the unit processor 128 may be 8-bit, 16-bit, 32-bit, 64-bit, or of any other suitable architecture. The unit processor 128 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The one or more processors are configured to implement and execute various instructions. The instructions may comprise any suitable set of instructions, logic, rules, or code operable to be executed. In this way, unit processor 128 may be a special-purpose computer designed to implement the functions disclosed herein.

Figure 5:
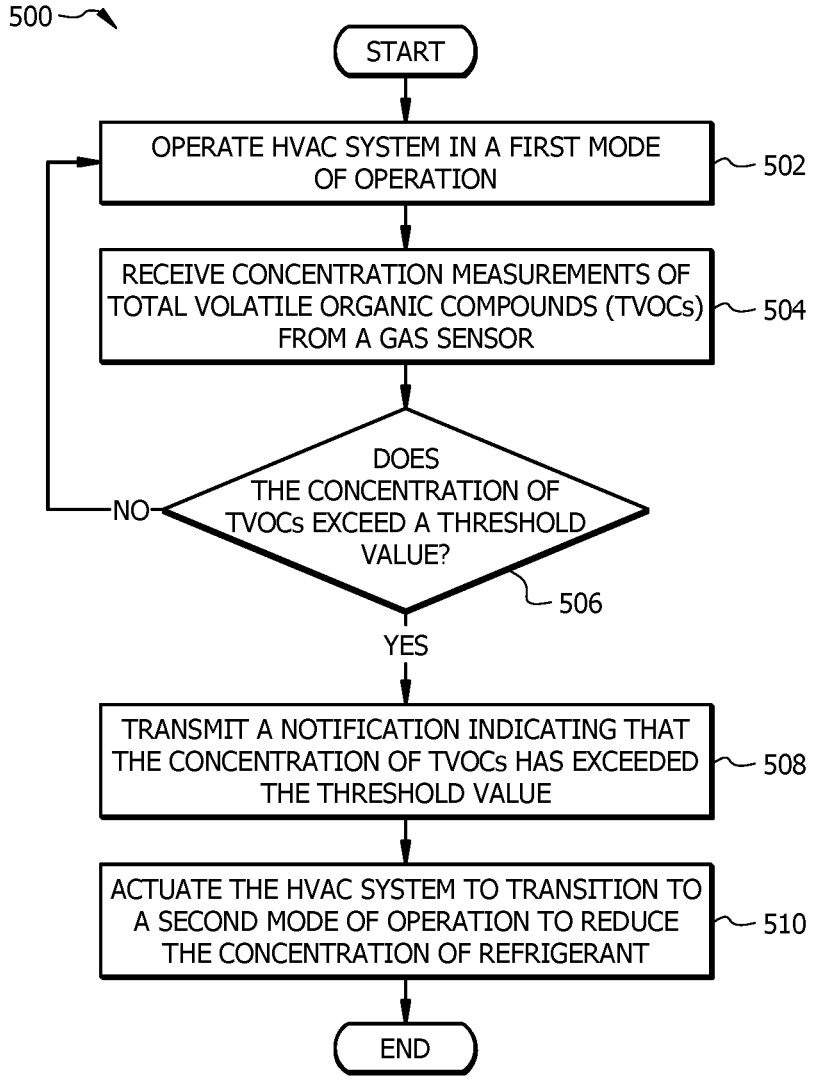
FIG. 5 is a flowchart of an example process for the HVAC system of FIG. 1.
Figure 6:
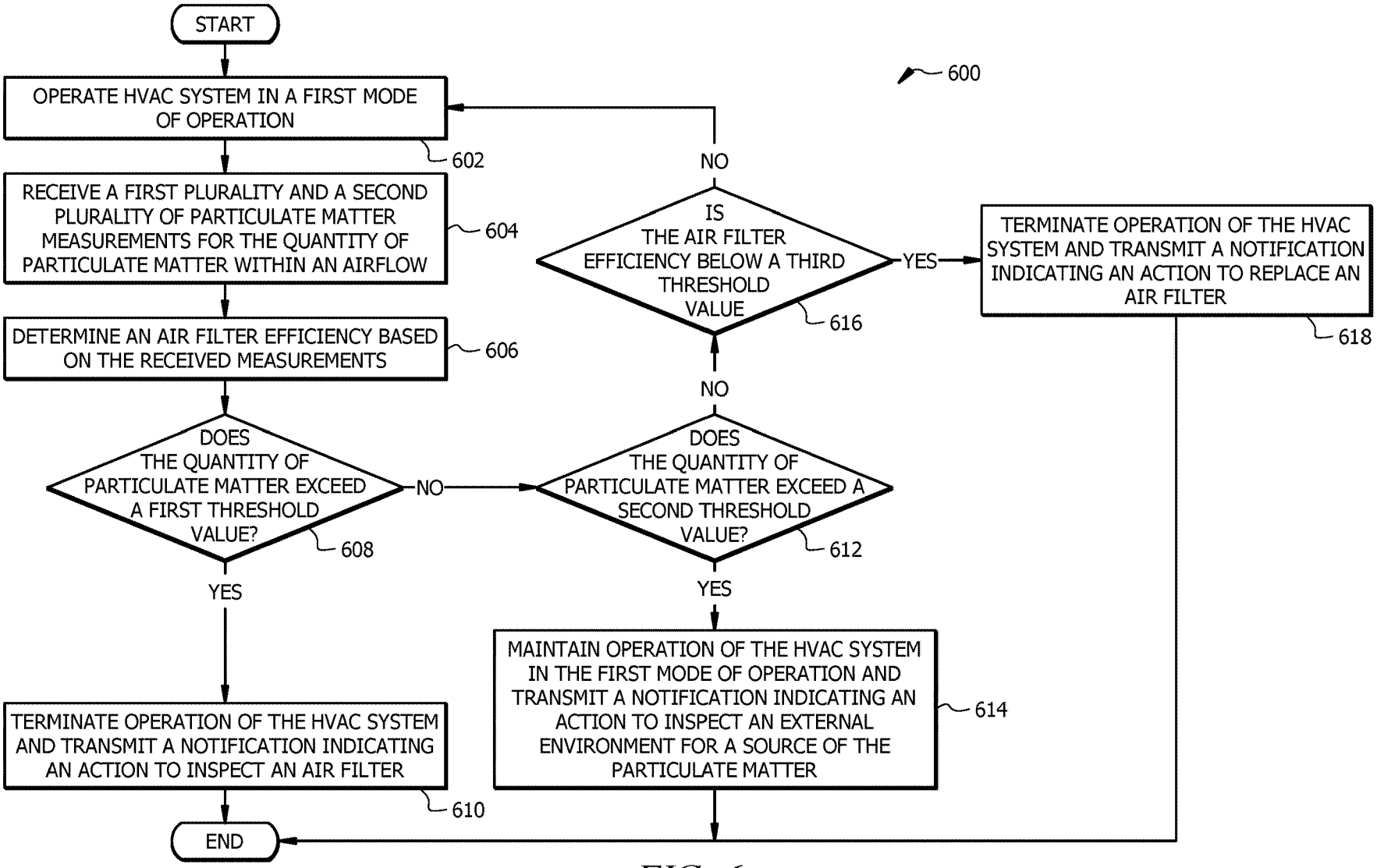
FIG. 6 is a flowchart of an example process for the HVAC system of FIG. 1.

The unit memory 130 is operable to store any of the information described with respect to FIGS. 1 and 5-6 along with any other data, instructions, logic, rules, or code operable to implement the function(s) described herein when executed by the unit processor 128. For example, the unit memory 130 may store a look-up table 131 comprising data associated with concentration of total volatile organic compounds and quantity of particulate matter (discussed further below in FIGS. 5-6) and one or more threshold values 133 associated with the look-up table 131. The unit memory 130 comprises one or more disks, tape drives, or solid-state drives, and may be used as an over-flow data storage device, to store programs when such programs are selected for execution, and to store instructions and data that are read during program execution. The unit memory 130 may be volatile or non-volatile and may comprise a read-only memory (ROM), random-access memory (RAM), ternary content-addressable memory (TCAM), dynamic random-access memory (DRAM), and static random-access memory (SRAM).

The network interface 132 is configured to enable wired and/or wireless communications. The network interface 132 is configured to communicate data between the unit controller 126 and other devices (e.g. sensors and the HVAC system 100), systems, or domains. For example, the network interface 132 may comprise an NFC interface, a Bluetooth interface, a Zigbee interface, a Z-wave interface, an RFID interface, a WIFI interface, a LAN interface, a WAN interface, a PAN interface, a modem, a switch, or a router. The unit processor 128 may be configured to send and receive data using the network interface 132. The network interface 132 may be configured to use any suitable type of communication protocol as would be appreciated by one of ordinary skill in the art.

In further embodiments, unit controller 126 may include a display that is a graphical user interface configured to present visual information to a user using graphical objects. Examples of a display include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

A portion of the HVAC system 100 may be configured to move air through the evaporator 116 and out of the duct sub-system 122. Return air 134, which may be air returning from the building, fresh air from outside, or some combination, is pulled into a return duct 136. A variable-speed blower, such as blower 126, may pull the return air 134 into the return duct 136 where the discharged airflow 118 is then directed to cross the evaporator 116 or heating elements (not shown) to produce the treated airflow 120. In these embodiments, the return air 134 may be the same airflow as airflow 118 or may be discharged as airflow 118 by blower 126.

The HVAC system 100 may comprise one or more sensors 138 in signal communication with the unit controller 126. The sensors 138 may comprise any suitable type of sensor for measuring a parameter of the air (i.e., temperature, pressure, humidity, etc.). The sensors 138 may be positioned anywhere within a conditioned space (e.g. a room or building) and/or the HVAC system 100. For example, the HVAC system 100 may comprise a sensor 138 positioned and configured to measure an outdoor air temperature. As another example, the HVAC system 100 may comprise a sensor 138 positioned and configured to measure a supply or treated air temperature and/or a return air temperature. In other examples, the HVAC system 100 may comprise sensors 138 positioned and configured to measure any other suitable type of air temperature, pressure, humidity, or any other suitable parameter.

As illustrated, the HVAC system 100 may comprise an air filter 140 disposed upstream of evaporator 116. Before flowing through the evaporator 116, the airflow 118 may engage with the air filter 140. The air filter 140 may be any suitable filter configured to remove at least a portion of particles or particulate matter present within an airflow. The air filter 140 may be configured to remove particles from airflow 118 prior to the HVAC system 100 discharging the air after treatment (i.e., as treated airflow 120).

The HVAC system 100 may further comprise a first sensor housing 142 and a second sensor housing 144. The first sensor housing 142 may be disposed upstream of the air filter 140, and the second sensor housing 144 may be disposed between the air filter 140 and the evaporator 116. Both the first sensor housing 142 and the second sensor housing 144 may be configured to house and contain one or more sensors operable to detect measurements associated with the airflow 118. The one or more sensors contained in the first sensor housing 142 and second sensor housing 144 may be communicatively coupled to the unit controller 126, wherein the unit controller 126 may transmit instructions to HVAC system 100 based on measurements received from the one or more sensors of the first sensor housing 142 and second sensor housing 144.

In embodiments, HVAC system 100 may comprise one or more thermostats, for example, located within a conditioned space (e.g. a room or building). The thermostat may be a single-stage thermostat, a multi-stage thermostat, or any suitable type of thermostat as would be appreciated by one of ordinary skill in the art. The thermostat may be configured to allow a user to input a desired temperature or temperature set point for a designated space or zone such as the room.

Example Sensor Housing

Figure 2A:
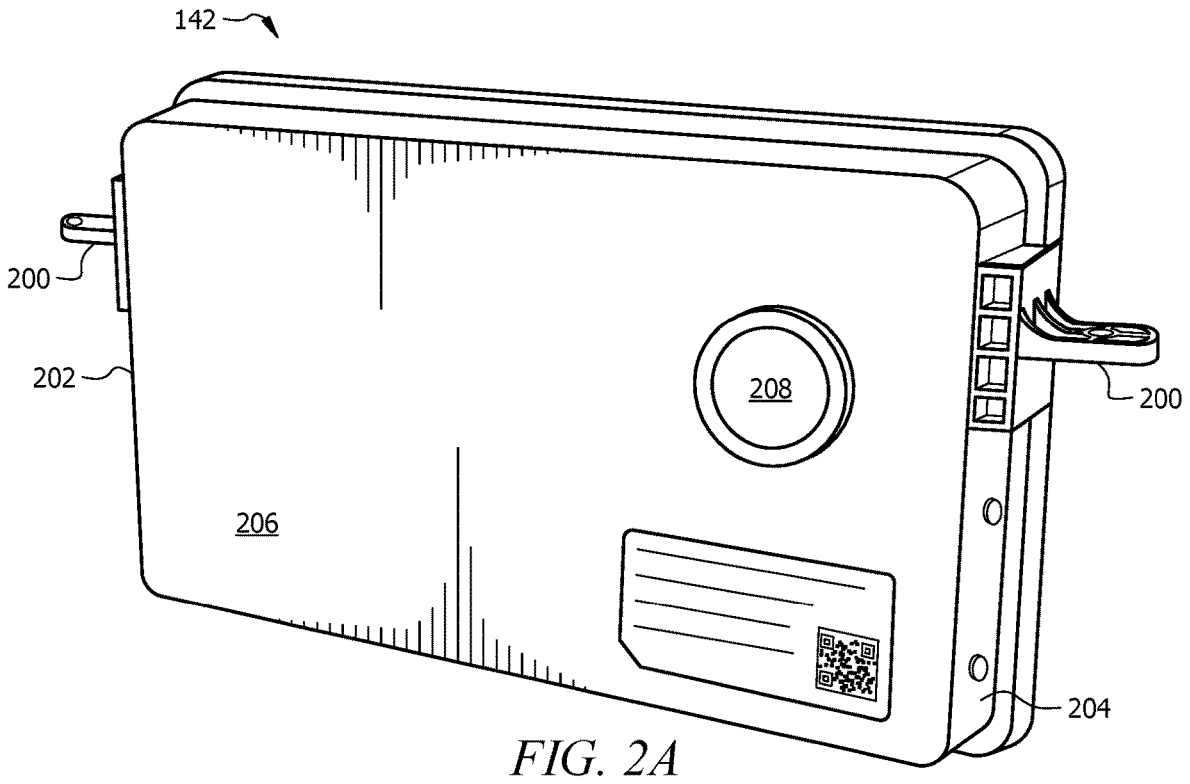
FIG. 2A is an isometric, front view of a sensor housing of the HVAC system of FIG. 1.
Figure 2B:
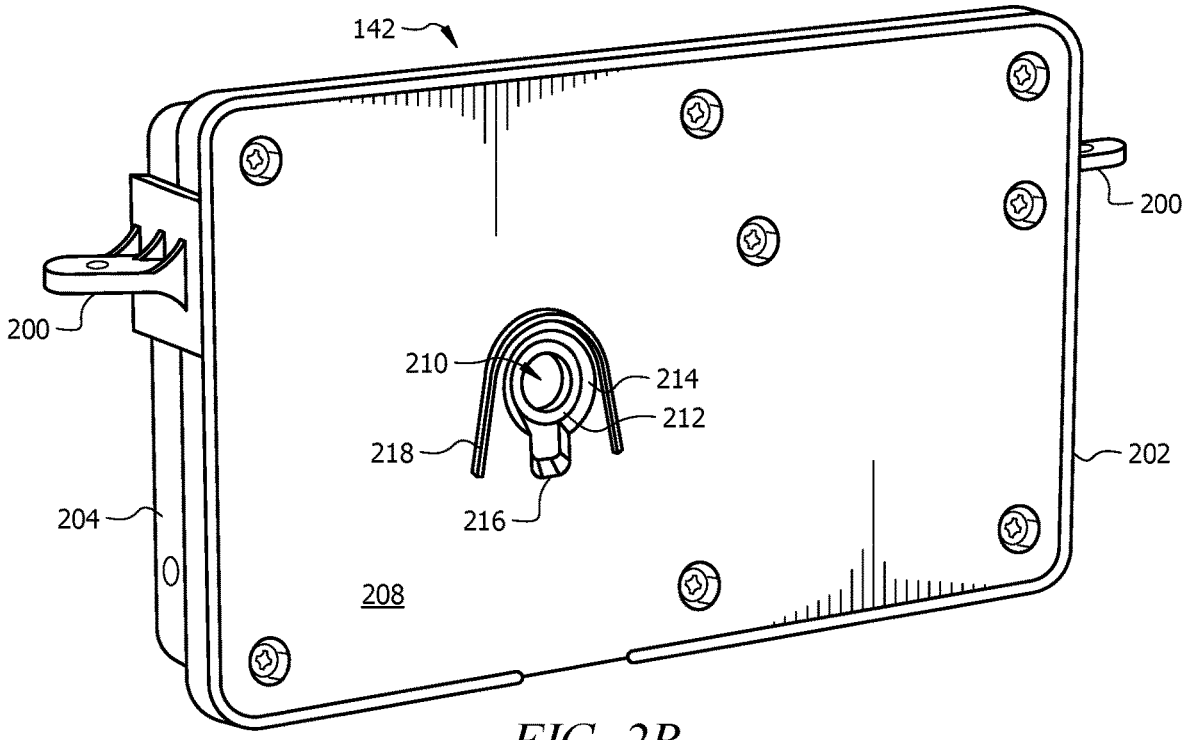
FIG. 2B is an isometric, back view of a sensor housing of the HVAC system of FIG. 1.

FIGS. 2A-2B illustrate an isometric view of the first sensor housing 142 of the HVAC system 100. FIG. 2A illustrates a front view of the first sensor housing 142, and FIG. 2B illustrates a back view of the first sensor housing 142. While first sensor housing 142 is illustrated in FIGS. 2A-2B and further in FIGS. 2C-2D, the present disclosure may apply the same concepts and components to second sensor housing 144 (referring to FIG. 1). As described above, the first sensor housing 142 may be operable to house and protect internal components from an external environment. The first sensor housing 142 may comprise any suitable size, height, shape, and any combinations thereof. Further, the first sensor housing 142 may comprise any suitable materials, such as metals, nonmetals, polymers, composites, and any combinations thereof.

As illustrated, the first sensor housing 142 may comprise a plurality of sides. The plurality of sides may be coupled together through any suitable means to form the first sensor housing 142. Without limitations, suitable coupling means may include fasteners, adhesives, brazing, welding, snap-fit, interference fit, and any combination thereof. As depicted, a pair of mounting brackets 200 may be coupled to the first sensor housing 142. For example, one of the pair of mounting brackets 200 may be disposed on a first side 202 of the first sensor housing 142, and the remaining one of the pair of mounting brackets 200 may be disposed on a second side 204 of the first sensor housing 142 opposite from the first side 202. Each one of the pair of mounting brackets 200 may be disposed at an equivalent height with reference to the first sensor housing 142. In other embodiments, the pair of mounting brackets 200 may be disposed at different heights. The pair of mounting brackets 200 may be configured to secure the first sensor housing 142 in the HVAC system 100 (referring to FIG. 1). The pair of mounting brackets 200 may be any suitable bracket or hardware operable to receive a structure to secure the first sensor housing 142 in place.

A front side 206 of the first sensor housing 142 may be disposed between the first side 202 and the second side 204. In embodiments, a first opening 208 may be defined in the front side 206 operable to introduce an airflow into the first sensor housing 142. The first opening 208 may be disposed at any suitable location along the front side 206. For example, the first sensor housing 142 may be disposed in a flow path for the airflow 118 (referring to FIG. 1). At least a portion of the airflow 118 may flow into the first sensor housing 142 through the first opening 208, wherein measurements of the airflow 118 may be taken. In this example, the first sensor housing 142 may be disposed perpendicular to a direction of the flow path of the airflow 118, wherein the front side 206 faces the direction of the flow path of the airflow 118.

A back side 208 of the first sensor housing 142 may be disposed between the first side 202 and the second side 204 and opposite from the front side 206. In embodiments, a slot 210 may be defined in the back side 208 operable to communicatively couple an external device to a controller disposed within the first sensor housing 142 (discussed further below in FIG. 2D). The slot 210 may be disposed at any suitable location along the back side 208 and may be operable to allow partial passage through for a component. The slot 210 may comprise any suitable size, height, shape, and any combinations thereof. In embodiments, the slot 210 may be a fast Fourier transform (FFT) connection.

As illustrated, the slot 210 may comprise a raised ring 212 encircling the opening through the back side 208, wherein there is a recessed ring 214 disposed around the raised ring 212. The recessed ring 214 may be concentric with the raised ring 212. The recessed ring 214 may further comprise a sloped lip 216 disposed at the bottom of the recessed ring 214. In embodiments, the configuration of the raised ring 212, recessed ring 214, and sloped lip 216 may be configured to prevent a fluid from entering into the slot 210. For example, a fluid may engage with the back side 208 and may flow down towards slot 210. The recessed ring 214 and sloped lip 216 may direct any potential fluid out and away from the opening defined by the slot 210. Further, there may be a barrier 218 disposed at least partially around the slot 210. The barrier 218 may protrude out from the back side 208 by a certain height and may be configured to inhibit fluid flow from reaching the slot 210. As illustrated, the barrier 218 may be curvilinear, but the barrier 218 may comprise any suitable shape.

Figure 2C:
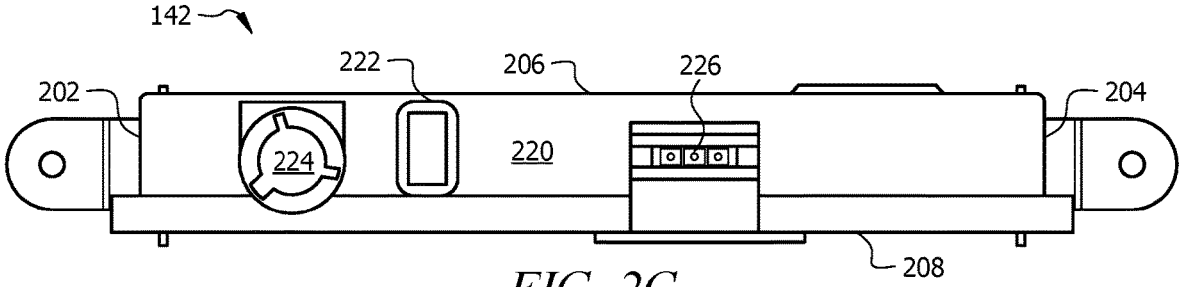
FIG. 2C is a bottom view of a sensor housing of the HVAC system of FIG. 1.

FIG. 2C illustrates a bottom view of the first sensor housing 142. As illustrated, a bottom side 220 of the first sensor housing 142 may be disposed between the first side 202 and the second side 204. The bottom side 220 may further be disposed between and perpendicular to the front side 206 and the back side 208. In embodiments, an inlet 222 and an outlet 224 may be defined in the bottom side 220 operable to introduce an airflow into the first sensor housing 142. Both the inlet 222 and outlet 224 may be disposed at any suitable location along the bottom side 220. In embodiments, the inlet 222 and outlet 224 may be configured to direct an airflow to and from an air quality sensor disposed within the first sensor housing 142 (discussed further below in FIG. 2D). For example, at least a portion of the airflow 118 (referring to FIG. 1) being directed to evaporator 116 (referring to FIG. 1) may flow through the inlet 222, wherein air quality measurements of the airflow 118 may be taken.

Then, that portion of airflow 118 may be discharged out through the outlet 224. The bottom side 220 may further comprise a connector access point 226 configured to communicatively couple an external component to a controller disposed within the first sensor housing 142 (discussed further below in FIG. 2D). For example, the connector access point 226 may be utilized to provide power to the controller disposed within the first sensor housing 142.

Figure 2D:
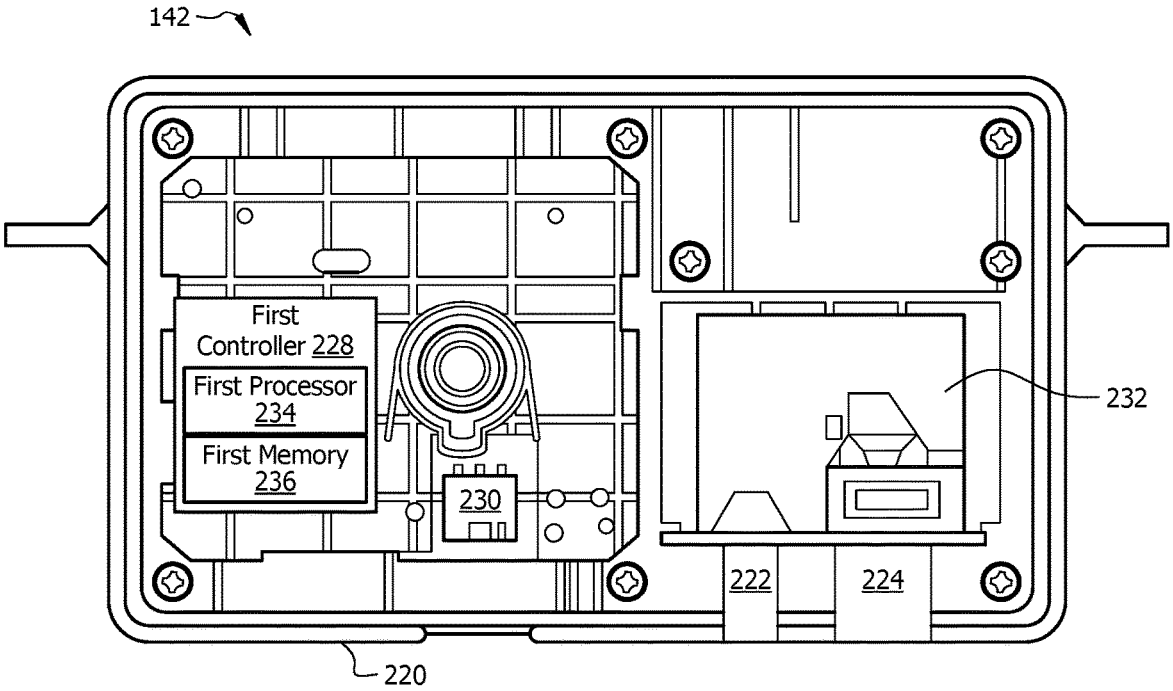
FIG. 2D is a cross-sectional view of a sensor housing of the HVAC system of FIG. 1.

FIG. 2D illustrates a cross-sectional view of the first sensor housing 142. As previously described above, the present disclosure may apply the same concepts and components to the second sensor housing 144 (referring to FIG. 1) although only depicting the first sensor housing 142. The first sensor housing 142 may be configured to house and/or contain a first controller 228, a gas sensor 230, and a first air quality sensor 232. The first controller 228 may be in signal communication with the gas sensor 230, first air quality sensor 232, and the unit controller 126 (referring to FIG. 1). Signal communication may be facilitated by using a wired or wireless connection. For example, the first controller 228 may be connected to the unit controller 126 via Bluetooth, near-field communications, or any other suitable communication protocol. The first controller 228 may be configured to provide commands or signals to control the operation of and to receive measurements from the gas sensor 230 and first air quality sensor 232. For example, the first controller 228 may be configured to provide power to the gas sensor 230 and first air quality sensor 232. In another example, the first controller 228 may be configured to receive a plurality of concentration measurements from the gas sensor 230 and to receive a plurality of particulate matter measurements from the first air quality sensor 232.

In embodiments, the first controller 228 may be a printed circuit board and may comprise a first processor 234 and a first memory 236. The first processor 234 may comprise one or more processors operably coupled to the first memory 236. The first processor 234 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The first processor 234 may be a programmable logic device, a microcontroller, a microprocessor, or any suitable combination of the preceding. The first processor 234 is communicatively coupled to and in signal communication with the first memory 236. The one or more processors may be configured to process data and may be implemented in hardware or software. For example, the first processor 234 may be 8-bit, 16-bit, 32-bit, 64-bit, or of any other suitable architecture. The first processor 234 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The one or more processors are configured to implement and execute various instructions. The instructions may comprise any suitable set of instructions, logic, rules, or code operable to be executed. In this way, first processor 234 may be a special-purpose computer designed to implement the functions disclosed herein.

The first memory 236 is operable to store any of the information described with respect to FIGS. 2D and 5-6 along with any other data, instructions, logic, rules, or code operable to implement the function(s) described herein when executed by the first processor 234. For example, the first memory 236 may store the received data associated with concentration of total volatile organic compounds from the gas sensor 230 and quantity of particulate matter from the first air quality sensor 232. The first memory 236 comprises one or more disks, tape drives, or solid-state drives, and may be used as an over-flow data storage device, to store programs when such programs are selected for execution, and to store instructions and data that are read during program execution. The first memory 236 may be volatile or non-volatile and may comprise a read-only memory (ROM), random-access memory (RAM), ternary content-addressable memory (TCAM), dynamic random-access memory (DRAM), and static random-access memory (SRAM).

In an example, the first controller 228 may receive a plurality of concentration measurements from the gas sensor 230. The gas sensor 230 may be configured to detect a concentration of total volatile organic compounds (TVOCs) within an airflow, such as airflow 118 (referring to FIG. 1). Any suitable gas sensor may be used as the gas sensor 230. In embodiments, the gas sensor 230 may be configured to measure a concentration of TVOCs in parts-per-million (ppm). For example, during operation of HVAC system 100 (referring to FIG. 1), at least a portion of airflow 118 may flow into the first sensor housing 142 via first opening 208 (referring to FIG. 2A). As airflow 118 enters the first sensor housing 142, gas sensor 230 may detect a concentration of TVOCs present within airflow 118. The first controller 228 may then receive a plurality of concentration measurements from the gas sensor 230, which may then be transmitted to the unit controller 126 for further operations.

In another example, the first controller 228 may receive a plurality of particulate matter measurements from the first air quality sensor 232. The first air quality sensor 232 may be configured to detect a quantity of particulate matter within an airflow, such as airflow 118. Any suitable air quality sensor capable of measuring particulate matter may be used as the first air quality sensor 232. In embodiments, the first air quality sensor 232 may be configured to measure fine particulate matter, which may refer to particles with a width of 2.5 microns or less ($PM_{2.5}$). In further embodiments, the first air quality sensor 232 may be configured to measure particles having a width greater than fine particulate matter, such as from about 5 microns to about 50 microns, or any other suitable value. For example, during operation of HVAC system 100, at least a portion of airflow 118 may flow into the first sensor housing 142 via inlet 222 through the bottom side 220. In embodiments, first air quality sensor 232 may comprise a fan operable to facilitate air flow through inlet 222 and out outlet 224. As airflow 118 enters the first sensor housing 142, the airflow 118 may be directed through the first air quality sensor 232. The first air quality sensor 232 may detect a quantity of particulate matter present within airflow 118. The first controller 228 may then receive a plurality of particulate matter measurements from the first air quality sensor 232, which may then be transmitted to the unit controller 126 for further operations. The plurality of particulate matter measurements received from first controller 228 may be representative of the particulate matter present within the airflow 118 before the airflow 118 engages with the air filter 140 (referring to FIG. 1).

In further embodiments, the second sensor housing 144 (referring to FIG. 1) may comprise the same components as first sensor housing 142 and operate similarly as first sensor housing 144. As second sensor housing 142 is disposed between the air filter 140 and the evaporator 116 (referring to FIG. 1), the plurality of particulate matter measurements received by the unit controller 126 from a controller disposed within second sensor housing 144 may be representative of the particulate matter present within the airflow 118 after the airflow 118 engages with the air filter 140. Having received both a first plurality of particulate matter measurements from the first controller 228 and a second plurality of particulate matter measurements from a controller associated with second sensor housing 144, the unit controller 126 may be configured to determine an air filter efficiency for the air filter 140.

Figure 3:
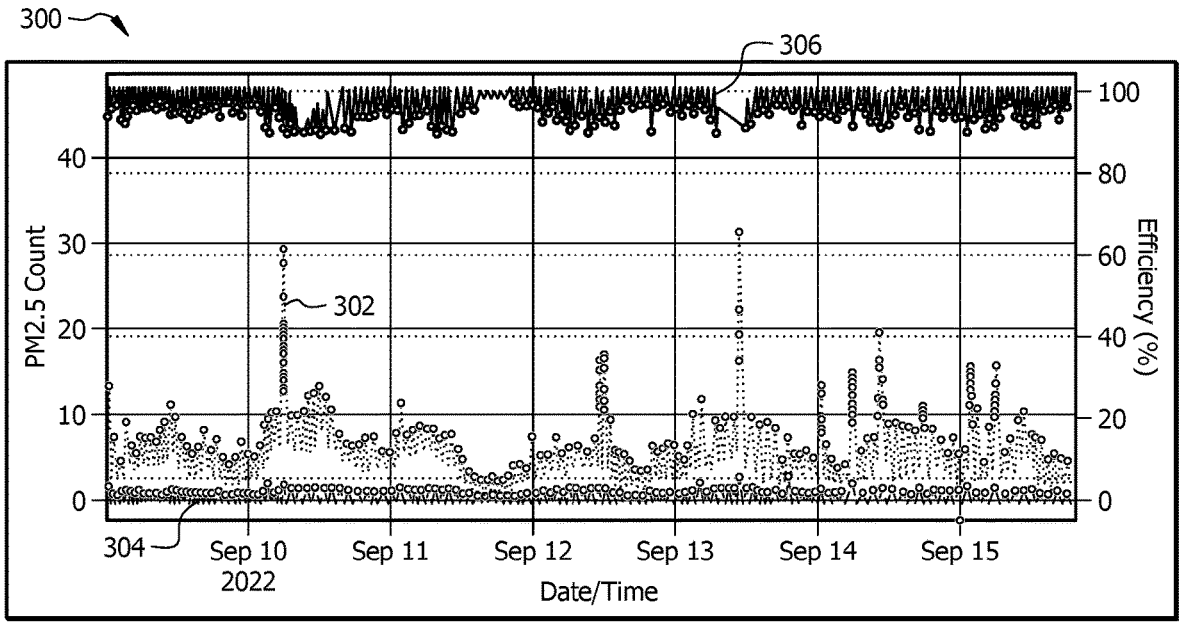
FIG. 3 is a graph illustrating air filter efficiency and quantity of particulate matter over time.

FIG. 3 illustrates a graph 300 showing air filter efficiency and quantity of particulate matter within the airflow 118 (referring to FIG. 1) over time. Graph 300 depicts a first line 302 illustrating the first plurality of particulate matter measurements received from the first sensor housing 142 (referring to FIG. 1), a second line 304 illustrating the second plurality of particulate matter measurements received from the second sensor housing 144 (referring to FIG. 1), and a third line 306 illustrating performance of the air filter 140 (referring to FIG. 1). In these embodiments, performance of the air filter 140 is measured as the air filter efficiency. As illustrated, the HVAC system 100 (referring to FIG. 1) was able to determine the efficiency of the air filter 140 by measuring the quantity of particulate matter within the airflow 118 (referring to FIG. 1) before and after the airflow 118 engages with the air filter 140.

Figure 4:
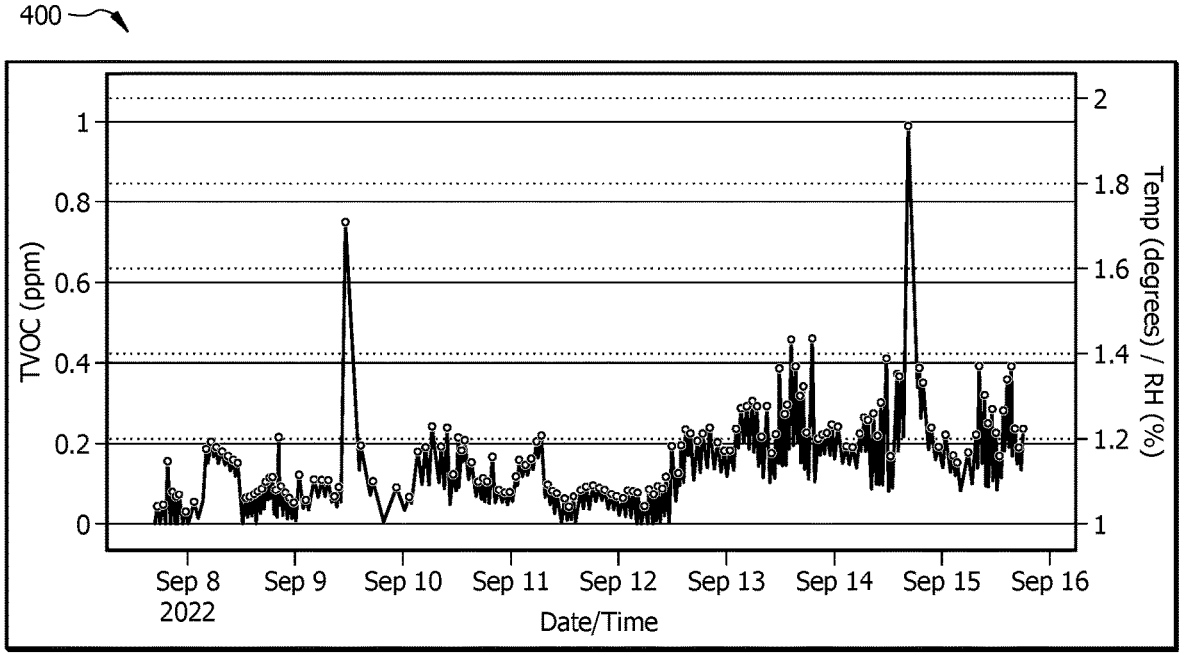
FIG. 4 is a graph illustrating concentration of total volatile organic compounds over time.

FIG. 4 illustrates a graph 400 showing concentration of TVOCs over time. Graph 400 depicts the plurality of concentration measurements received from either first sensor housing 142 (referring to FIG. 1) or the second sensor housing 144 (referring to FIG. 1). In embodiments, placement of the gas sensor 230 (referring to FIG. 2D) upstream or downstream of the air filter 140 (referring to FIG. 1) may not affect a change in the detected concentration of TVOCs in the airflow 118 (referring to FIG. 1). The HVAC system 100 (referring to FIG. 1) may be operable to receive the plurality of concentration measurements from one of the first sensor housing 142 and the second sensor housing 144 to avoid a redundancy in processing approximately the same measurements.

Example Operation of the HVAC System Based on Concentration of TVOCs

FIG. 5 is a flowchart of an embodiment of a process 500 for the HVAC system 100. The HVAC system 100 may employ process 500 for operating first sensor housing 142 (referring to FIG. 1), second sensor housing 144 (referring to FIG. 1), and the HVAC system 100 based on concentration of TVOCs. At operation 502, unit processor 128 (referring to FIG. 1) of the unit controller 126 (referring to FIG. 1) may operate the HVAC system 100 in a first mode of operation. For example, the first mode of operation may be a refrigeration cycle or a heat pump cycle. The unit processor 128 may transmit instructions to turn on the blower 124 (referring to FIG. 1), the compressor 106 (referring to FIG. 1), the fan 110 (referring to FIG. 1), and any combination thereof. Operation of the aforementioned components may enable heat transfer between the refrigerant flowing within the working-fluid conduit subsystem 102 (referring to FIG. 1) and either the condenser 108 (referring to FIG. 1) or the evaporator 116 (referring to FIG. 1).

At operation 504, the unit processor 128 of the unit controller 126 may receive a plurality of concentration measurements from the gas sensor 230 (referring to FIG. 2D). For example, during operation of HVAC system 100 in a first mode of operation, at least a portion of the airflow 118 (referring to FIG. 1) may flow into the first sensor housing 142 or the second sensor housing 144 via the first opening 208 (referring to FIG. 2A). As airflow 118 flows through the first opening 208, gas sensor 230 may detect a concentration of TVOCs present within airflow 118. The controller of first sensor housing 142 or second sensor housing 144, such as first or second controller 228 (referring to FIG. 2D) may then receive a plurality of concentration measurements from the gas sensor 230, which may be transmitted to the unit controller 126 for further operations. In this example, placement of gas sensor 230 relative to the air filter 140 (referring to FIG. 1) may not affect the measurements, and unit controller 126 may receive concentration measurements from either first sensor housing 142 or second sensor housing 144.

At operation 506, the unit processor 128 of the unit controller 126 may determine whether or not the concentration of TVOCs in the airflow 118 exceeds a threshold value. For example, the unit memory 130 (referring to FIG. 1) may store the threshold value for a concentration of TVOCs in an airflow as a first threshold value 133*a* (referring to FIG. 1). In embodiments, the first threshold value 133*a* may be 1 ppm. If the unit processor 128 determines that the concentration of TVOCs in the airflow 118 does not exceed the stored first threshold value 133*a*, the process 500 proceeds back to operation 502. Otherwise, the process 500 proceeds to operation 508.

At operation 508, the unit processor 128 of the unit controller 126 may transmit a notification indicating that the concentration of TVOCs in the airflow 118 exceeds a threshold value. Transmission of the notification may occur in conjunction with, before, or after the HVAC system 100 transitions from the first mode of operation to a second mode of operation to reduce the concentration of TVOCs.

At operation 510, the unit processor 128 of the unit controller 126 may actuate the HVAC system 100 to transition to the second mode of operation. During the second mode of operation, the unit processor 128 may transmit an instruction to turn off the compressor 106 and to actuate the blower 126 to discharge an airflow. In these embodiments, the airflow may comprise a concentration of TVOCs exceeding the stored first threshold value (i.e., 1 ppm). Discharging the airflow may reduce the concentration of TVOCs present within the HVAC system 100 and areas fluidly coupled to the HVAC system 100. In other examples, the unit processor 128 may further determine whether the concentration of TVOCs in the airflow 118 exceeds a second threshold value, wherein the second threshold value is greater than first threshold value 133*a*. In response to determining that the concentration of TVOCs in the airflow 118 does exceed the second threshold value, the unit processor 128 may transmit a notification indicating an action to inspect an external environment for a source of the TVOCs. In this example, there may be a source proximate to the HVAC system 100 generating TVOCs. The HVAC system 100 may prompt a user to mitigate potential sources to reduce the concentration of TVOCs in the surrounding ambient air. The process 500 may then proceed to end.

Example Operation of the HVAC System Based on Quantity of Particulate Matter

FIG. 6 is a flowchart of an embodiment of a process 600 for the HVAC system 100. The HVAC system 100 may employ process 600 for operating first sensor housing 142 (referring to FIG. 1), second sensor housing 144 (referring to FIG. 1), and the HVAC system 100 based on particulate matter count. At operation 602, unit processor 128 (referring to FIG. 1) of the unit controller 126 (referring to FIG. 1) may operate the HVAC system 100 in a first mode of operation. For example, the first mode of operation may be a refrigeration cycle or a heat pump cycle. The unit processor 128 may transmit instructions to turn on the blower 124 (referring to FIG. 1), the compressor 106 (referring to FIG. 1), the fan 110 (referring to FIG. 1), and any combination thereof. Operation of the aforementioned components may enable heat transfer between the refrigerant flowing within the working-fluid conduit subsystem 102 (referring to FIG. 1) and either the condenser 108 (referring to FIG. 1) or the evaporator 116 (referring to FIG. 1).

At operation 604, the unit processor 128 of the unit controller 126 may receive a first plurality of particulate matter measurements and a second plurality of particulate matter measurements. For example, during operation of HVAC system 100 in a first mode of operation, at least a portion of airflow 118 (referring to FIG. 1) may flow into the first sensor housing 142 (referring to FIG. 1) via inlet 222 (referring to FIG. 2D). As airflow 118 enters the first sensor housing 142, the airflow 118 may be directed through the first air quality sensor 232 (referring to FIG. 2D). The first air quality sensor 232 may detect a quantity of particulate matter present within airflow 118. The first controller 228 (referring to FIG. 2D) may then receive a plurality of particulate matter measurements from the first air quality sensor 232, which may then be transmitted to the unit controller 126 for further operations. The plurality of particulate matter measurements received from first controller 228 may be representative of the particulate matter present within the airflow 118 before the airflow 118 engages with the air filter 140 (referring to FIG. 1). The second sensor housing 144 may operate similarly and provide the plurality of particulate matter measurements representative of the particulate matter present within the airflow 118 after the airflow 118 engages with the air filter 140.

At operation 606, the unit processor 128 of the unit controller 126 may determine an air filter efficiency for the air filter 140 based on the received first plurality of particulate matter measurements and a second plurality of particulate matter measurements. In embodiments, the air filter efficiency for the air filter 140 may be indicative of the performance of the air filter 140. For example, if the particulate matter count detected by the first sensor housing 142 and the second sensor housing 144 is 20 and 2, respectively, the unit processor 128 may determine that the air filter efficiency is 90%.

At operation 608, the unit processor 128 of the unit controller 126 may determine whether or not the quantity of particulate matter in the airflow 118 exceeds a first threshold value. This determination may occur based on the received second plurality of particulate matter measurements. For example, the unit memory 130 (referring to FIG. 1) may store the threshold value for a quantity of particulate matter in an airflow as a first threshold value 133*a* (referring to FIG. 1). In embodiments, the first threshold value 133*a* may be a value count of 30. If the unit processor 128 determines that the quantity of particulate matter in the airflow 118 does not exceed the stored first threshold value 133*a*, the process 600 proceeds to operation 612. Otherwise, the process 600 proceeds to operation 610.

At operation 610, the unit processor 128 of the unit controller 126 may transmit a notification indicating an action for the user to inspect the air filter 140. Transmission of the notification may occur in conjunction with, before, or after the HVAC system 100 terminates operation. The unit processor 128 may further initiate termination of operation of HVAC system 100 after determining that the quantity of particulate matter in the airflow 118 after passing through the air filter 140 exceeds the stored threshold value. The process 600 would then proceed to end.

At operation 612, the unit processor 128 of the unit controller 126 may determine whether or not the quantity of particulate matter in the airflow 118 exceeds a second threshold value less than the first threshold value. If the unit processor 128 determines that the quantity of particulate matter in the airflow 118 does not exceed the second threshold value, the process 600 proceeds to operation 616. Otherwise, the process 600 proceeds to operation 614.

At operation 614, the unit processor 128 of the unit controller 126 may transmit a notification indicating an action to inspect an external environment for a source of the particulate matter. In this example, there may be a source proximate to the HVAC system 100 generating particulate matter. The HVAC system 100 may prompt a user to mitigate potential sources to reduce the quantity of particulate matter in the surrounding ambient air. The unit processor 128 may further maintain operation of HVAC system 100 in the first mode of operation. The process 600 would then proceed to end.

At operation 616, the unit processor 128 of the unit controller 126 may determine whether or not the air filter efficiency for the air filter 140 is less than a third threshold value. For example, the third threshold value may be 60%. If the unit processor 128 determines that the air filter efficiency for the air filter 140 is less than the third threshold value, the process 600 proceeds to operation 618. Otherwise, the process 600 proceeds back to operation 602.

At operation 618, the unit processor 128 of the unit controller 126 may transmit a notification indicating an action for the user to inspect the air filter 140. Transmission of the notification may occur in conjunction with, before, or after the HVAC system 100 terminates operation. Alternatively, transmission of the notification may occur without terminating operation of the HVAC system 100. In these embodiments, the air filter 140 may be inspected by a user without terminating operation of the HVAC system 100. The unit processor 128 may further initiate termination of operation of HVAC system 100 after determining that the air filter efficiency for the air filter 140 is less than the third threshold value. The process 600 may then proceed to end.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A heating, ventilation, and air conditioning (HVAC) system, comprising:

an evaporator coil configured to receive an airflow and to transfer heat from the received airflow to a flow of refrigerant;

a compressor configured to receive the flow of refrigerant from the evaporator coil and to discharge the flow of refrigerant at a higher pressure;

a first sensor housing disposed upstream of the evaporator coil, comprising:

a gas sensor configured to detect a concentration of total volatile organic compounds (TVOCs) within the airflow; and a first controller operably coupled to the gas sensor, comprising:

a first memory configured to store a plurality of concentration measurements; and a first processor configured to receive the plurality of concentration measurements from the gas sensor; and a unit controller operably coupled to the first controller, comprising:

a unit memory configured to store a first threshold value associated with the concentration of TVOCs; and a unit processor operably coupled to the unit memory, configured to:

operate the HVAC system in a first mode of operation;

during the first mode of operation:

transmit instructions to turn on a blower;

send a command to actuate the evaporator coil and the compressor;

receive the plurality of concentration measurements from the first controller;

determine if the concentration of TVOCs in the airflow exceeds the stored first threshold value based on the received plurality of concentration measurements; and in response to determining that the concentration of TVOCs in the airflow does exceed the first threshold value, transition the HVAC system from the first mode of operation to a second mode of operation to increase ventilation; and during the second mode of operation:

transmit an instruction to turn off the compressor configured to receive the flow of refrigerant from the evaporator coil;

turn off the blower to discharge air from the HVAC system;

determine if the concentration of TVOCs in the airflow exceeds a second threshold value based on the received plurality of concentration measurements, wherein the second threshold value is greater than the first threshold value; and in response to determining that the concentration of TVOCs in the airflow does exceed the second threshold value, transmit a notification indicating an action to inspect an external environment for a source of the TVOCs.

2. The HVAC system of claim 1, wherein the first sensor housing is disposed between the evaporator coil and an air filter.

3. The HVAC system of claim 1, wherein an air filter is disposed upstream of the evaporator coil, and wherein the first sensor housing is disposed upstream of the air filter.

4. The HVAC system of claim 1, wherein there is a first opening defined in a first side of the first sensor housing operable to introduce the airflow into the first sensor housing, wherein the first side is perpendicular to a direction of the airflow.

5. The HVAC system of claim 1, wherein the first controller is communicatively connected to the unit controller through a wireless communication protocol.

6. The HVAC system of claim 1, wherein the unit processor is further configured to:

transmit a notification indicating that the concentration of TVOCs has exceeded the first threshold value in conjunction with the HVAC system transitioning from the first mode of operation to the second mode of operation.

7. The HVAC system of claim 1, further comprising a condensing unit configured to reject heat from the flow of refrigerant, wherein the condensing unit comprises a condenser and at least one fan.

8. The HVAC system of claim 1, further comprising an expansion device disposed upstream of the evaporator coil, wherein the expansion device is configured to remove pressure from the the flow of refrigerant.

9. A method of operating a heating, ventilation, and air conditioning (HVAC) system, comprising:

operating the HVAC system in a first mode of operation;

during the first mode of operation:

transmitting instructions to turn on a blower;

sending a command to actuate an evaporator coil and a compressor;

receiving a plurality of concentration measurements from a first controller operably coupled to a gas sensor configured to detect a concentration of total volatile organic compounds (TVOCs) within an airflow;

determining if a concentration of TVOCs in the airflow exceeds a first threshold value based on the received plurality of concentration measurements; and in response to determining that the concentration of TVOCs in the airflow does exceed the first threshold value, transitioning the HVAC system from the first mode of operation to operate in a second mode of operation to increase ventilation; and during the second mode of operation:

transmitting an instruction to turn off the compressor configured to receive a flow of refrigerant from the evaporator coil;

turning off the blower to discharge air from the HVAC system;

determining if the concentration of TVOCs in the airflow exceeds a second threshold value based on the received plurality of concentration measurements, wherein the second threshold value is greater than the first threshold value; and in response to determining that the concentration of TVOCs in the airflow does exceed the second threshold value, transmitting a notification indicating an action to inspect an external environment for a source of the TVOCs.

10. The method of claim 9, wherein the gas sensor is disposed between the evaporator coil and an air filter.

11. The method of claim 9, wherein an air filter is disposed upstream of the evaporator coil, and wherein the gas sensor is disposed upstream of the air filter.

12. The method of claim 9, wherein the gas sensor is disposed within a first sensor housing, wherein there is a first opening defined in a first side of the first sensor housing operable to introduce the airflow into the first sensor housing, wherein the first side is perpendicular to a direction of the airflow.

13. The method of claim 9, further comprising transmitting a notification indicating that the concentration of TVOCs has exceeded the first threshold value in conjunction with the HVAC system transitioning from the first mode of operation to the second mode of operation.

14. The method of claim 9, wherein a memory stores a look-up table and wherein the look-up table stores the first threshold value and the second threshold value.

15. A non-transitory computer-readable medium storing instructions that when executed by a processor, cause the processor to:

operate a heating, ventilation, and air conditioning (HVAC) system in a first mode of operation;

during the first mode of operation:

transmit instructions to turn on a blower;

send a command to actuate an evaporator coil and a compressor;

receive a plurality of concentration measurements from a first controller operably coupled to a gas sensor configured to detect a concentration of total volatile organic compounds (TVOCs) within an airflow;

determine if a concentration of TVOCs in the airflow exceeds a first threshold value based on the received plurality of concentration measurements; and in response to determining that the concentration of TVOCs in the airflow does exceed the first threshold value, transition the HVAC system from the first mode of operation to operate in a second mode of operation to increase ventilation; and during the second mode of operation:

transmit an instruction to turn off the compressor configured to receive a flow of refrigerant from the evaporator coil;

turn off the blower to discharge air from the HVAC system;

determine if the concentration of TVOCs in the airflow exceeds a second threshold value based on the received plurality of concentration measurements, wherein the second threshold value is greater than the first threshold value; and in response to determining that the concentration of TVOCs in the airflow does exceed the second threshold value, transmit a notification indicating an action to inspect an external environment for a source of the TVOCs.

16. The non-transitory computer-readable medium of claim 15, wherein the gas sensor is disposed between the evaporator coil and an air filter.

17. The non-transitory computer-readable medium of claim 15, wherein an air filter is disposed upstream of the evaporator coil, and wherein the gas sensor is disposed upstream of the air filter.

18. The non-transitory computer-readable medium of claim 15, wherein the gas sensor is disposed within a first sensor housing, wherein there is a first opening defined in a first side of the first sensor housing operable to introduce the airflow into the first sensor housing, wherein the first side is perpendicular to a direction of the airflow.

19. The non-transitory computer-readable medium of claim 15, wherein the first controller is communicatively connected to the processor through a wireless communication protocol.

20. The non-transitory computer-readable medium of claim 15, wherein the instructions further cause the processor to:

transmit a notification indicating that the concentration of TVOCs has exceeded the first threshold value in conjunction with the HVAC system transitioning from the first mode of operation to the second mode of operation.

* * * * *